US006219891B1

(12) United States Patent
Maurer et al.

(10) Patent No.: US 6,219,891 B1
(45) Date of Patent: Apr. 24, 2001

(54) LACING AID AND CONNECTOR

(76) Inventors: Denis S. Maurer, 3836 Oak Lane Cir. North, Apt. E, Indianapolis; Richard A. Maurer, 13075 Portsmouth Dr., Carmel, both of IN (US) 46268; John Brassil, 1137 Jeffery Ct. West, Northbrook, IL (US) 60062; Andrew Burroughs, 7404 7th Ave., Kenosha, WI (US) 53143; Peter Ehling, 1135 W. Fulton Market, 2R, Chicago, IL (US) 60607; David Little, 1510 N. Hudson, No. 3, Chicago, IL (US) 60610

( * ) Notice: Subject to any disclaimer, the term of this patent is extended or adjusted under 35 U.S.C. 154(b) by 0 days.

(21) Appl. No.: 09/010,215

(22) Filed: Jan. 21, 1998

Related U.S. Application Data

(60) Provisional application No. 60/036,193, filed on Jan. 21, 1997.

(51) Int. Cl.[7] ..... A43C 7/00

(52) U.S. Cl. ..... 24/713.2; 24/713.3; 24/714.8; 24/715

(58) Field of Search ..... 24/712.9, 713.2, 24/713.3, 713.4, 713.9, 714.1, 714.4, 714.5, 714.6, 714.8, 714.9, 715, 715.1, 715.2; 36/50.1

(56) References Cited

U.S. PATENT DOCUMENTS

| | | | |
|---|---|---|---|
| 64,489 | | 5/1867 | Christie . |
| 254,343 | * | 2/1882 | Lequin . |
| D. 357,576 | | 4/1995 | Steinweis . |

(List continued on next page.)

OTHER PUBLICATIONS

Catalog of G. Goldberg Co., Inc., 16 Proctor Street, Salem, MA 01970 (Also available on–line at www.shoeeyelets.com/products/catalog.htm (2 pgs) undated.

*Primary Examiner*—James R. Brittain
(74) *Attorney, Agent, or Firm*—Woodard, Emhardt, Naughton, Moriarty & McNett

(57) ABSTRACT

A lacing aid which assists in lacing two elements tightly together comprises a first open portion that is easily threaded and engages a lace with reduced friction, and a second portion for frictional restraint of the threaded lace. Such lacing aids of the invention may be formed by bending smooth and stiff but resilient wire to form a first portion providing an opening larger than a lace with smooth inner walls, permitting the lace to slip easily when it is being tightened, and a second lace-restraining portion formed adjacent to the first portion to which a tightened lace may be easily slipped and engaged. An eyelet-connecting structure that may be used to fasten a lacing aid to a substrate element can be formed by two legs projecting from a junction, with one of the legs including a sleeve for rotatably carrying a first portion of the lacing aid and with the distal ends of the legs providing structure, such as a pair of mating fasteners, for fastening the lacing aid to a substrate, one mate being carried by each of the legs. Detent-forming structure adjacent the sleeve can hold the eyelet being carried so it extends upwardly and away from the leg. Such a connecting structure can comprise thin sheet steel bent into a U-shape, with one of the legs of the U being stamped to form notch-like portions and bent adjacent the notch-like portions to form a sleeve sized to engage the first portion of the lacing aid with a snap-fit so the first portion of a lacing aid is captively, but rotatably, carried by the U-shaped clip and can be held in the notch-like portions upwardly away from the connecting structure for easy threading.

28 Claims, 14 Drawing Sheets

U.S. PATENT DOCUMENTS

| | | | | |
|---|---|---|---|---|
| D. 373,464 | | 9/1996 | Hnarakis . | |
| D. 377,114 | | 1/1997 | Crowley et al. . | |
| 421,321 | | 2/1890 | Schoonmaker . | |
| 505,909 | * | 10/1893 | Walden | 24/713.2 X |
| 695,012 | | 3/1902 | Telfer . | |
| 701,313 | | 6/1902 | Duffy . | |
| 729,361 | | 5/1903 | Lanz . | |
| 733,001 | * | 7/1903 | Bryant | 24/712.9 |
| 786,406 | * | 4/1905 | Boynton | 24/714.8 |
| 994,187 | * | 6/1911 | Mumaw | 24/713.2 X |
| 1,094,262 | | 4/1914 | Spangenberg . | |
| 1,159,648 | | 11/1915 | Champ . | |
| 1,163,573 | | 12/1915 | Thayer . | |
| 1,242,774 | | 10/1917 | Curry . | |
| 1,434,723 | * | 11/1922 | Triay, Jr. | 24/713.2 |
| 1,879,475 | | 9/1932 | Poon . | |
| 1,995,243 | * | 3/1935 | Clarke | 24/713.3 |
| 3,066,370 | * | 12/1962 | Epstein | 24/712.9 |
| 4,027,360 | | 6/1977 | Moser . | |
| 4,125,918 | | 11/1978 | Baumann . | |
| 4,507,878 | | 4/1985 | Semouha . | |
| 4,538,367 | * | 9/1985 | Adams | 24/714.6 X |
| 4,553,342 | | 11/1985 | Derderian et al. . | |
| 4,633,548 | * | 1/1987 | Siskind et al. | 24/715.1 |
| 4,899,466 | | 2/1990 | Skaja . | |
| 4,970,763 | * | 11/1990 | Nwoko | 24/714.4 |
| 4,999,889 | | 3/1991 | LeCouturer . | |
| 5,109,581 | | 5/1992 | Gould . | |
| 5,119,539 | * | 6/1992 | Curry | 24/712.9 X |
| 5,158,428 | | 10/1992 | Gessner et al. . | |
| 5,214,863 | * | 6/1993 | Skaja | 24/713.2 X |
| 5,295,315 | | 3/1994 | Osawa et al. . | |
| 5,345,697 | | 9/1994 | Quellais . | |
| 5,347,695 | * | 9/1994 | Lopez Saiz | 27/714.8 |
| 5,467,511 | * | 11/1995 | Kubo | 24/712.9 |
| 5,566,474 | | 10/1996 | Leick et al. . | |
| 5,755,044 | | 5/1998 | Veylupek . | |

* cited by examiner

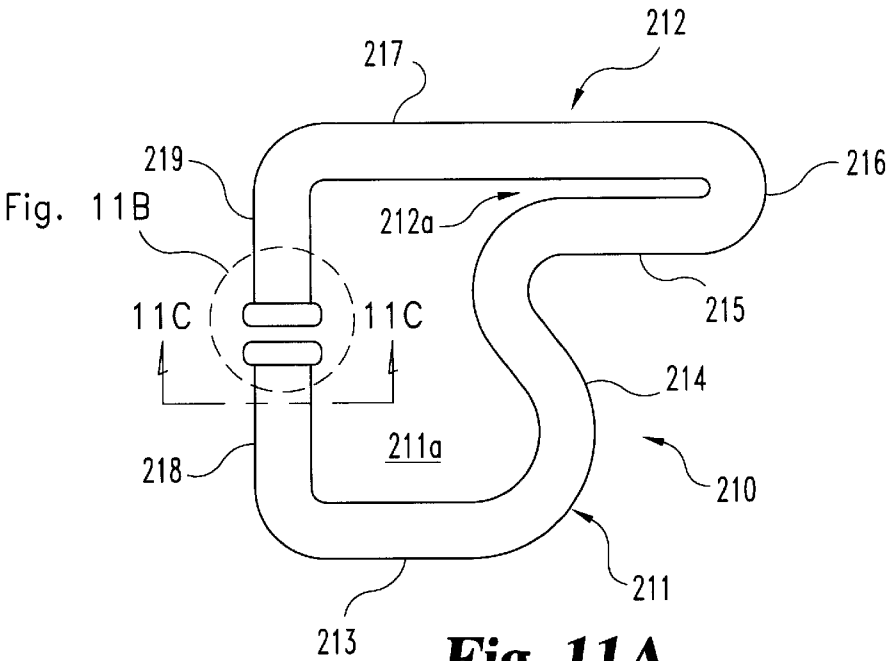
Fig. 11A
Fig. 11B
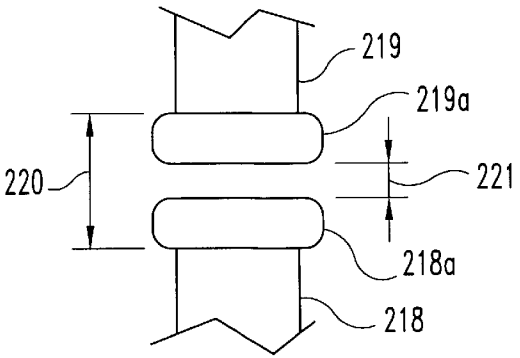
Fig. 11C
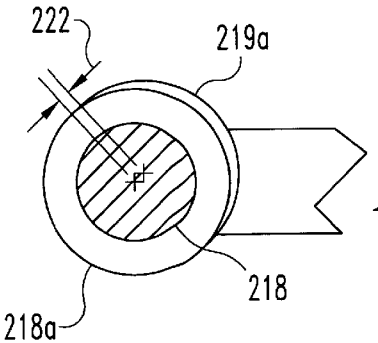

LACING AID AND CONNECTOR

This application claims the benefit of Provisional U.S. patent application Ser. No. 60/036,193 filed Jan. 21, 1997.

TECHNICAL FIELD OF THE INVENTION

The present invention relates to lacing devices, particularly lacing aids that may be easily used to lace tightly two elements together, and more particularly to lacing aids, and connecting means therefor, for facilitating the tight lacing of lace-tightened footwear, such as boots, ice skates, roller blades and roller skates.

BACKGROUND OF THE INVENTION

For many years, laces have been used to help secure footwear, such as boots, shoes, skates and the like, onto the feet of the user. A typical boot includes first and second instep flaps that extend up the sides of the boot and are separated by a space. Usually, the flaps extend from a point close to the toe of the boot and extend rearwardly to the front surface of the ankle portion of the boot. Each of the first and second instep flaps includes or carries a series of eyelets adjacent the space between them. A single lace is generally interwoven into the eyelets. By threading a lace through the eyelets and pulling on the ends of the lace, the eyelets and the instep flaps can be pulled together in the space between them to thus tighten the flaps, and hence the boot, around the foot of a user. After the flaps are tightened, the ends of the lace are tied together to hold the boot on the foot of the user.

When the user wishes to remove his boot, the lace ends are untied, and the lace can be loosened, permitting loosening of the instep flaps, that is, increasing the space between the first and second flaps. This increased space between and the first and second flaps loosens the boot, thus permitting the user to remove it from his foot. One difficulty with footwear lacing systems, is that it is often difficult to tighten the footwear by pulling the flaps together with the lace and to maintain a tightened condition.

In many applications, it is desirable, if not essential, to secure a boot snugly onto the foot of a user. Two examples of such applications are with ice skates (including figure, speed and hockey skates) and roller skates (both regular and in-line). With ice skates and roller skates, it is essential to have the boot of the ice skate fastened tightly around the ankle, so that the boot can provide ankle support to the user. This ankle support is necessary in order to ensure good skating performance. Additionally, in certain other applications, it is also essential to fasten a boot about a user's ankle tightly in order to give the user proper ankle support. Further, certain users, as a matter of individual preference, prefer to wear boots which are snugly secure to their feet, to provide appropriate ankle support.

Several known methods exist for tightly lacing a boot onto a foot. Typically, a boot lace is tightened by having the user start with one pair of the lower eyelets of the instep flaps of the boot and, using two hands (or fingers), to grip the lace adjacent a pair of eyelets and to pull the pair of eyelets toward with the lace to tighten the instep flaps at the particular pair of eyelets. The same procedure is then repeated with the next eyelet "up the boot" in the rearward direction while trying to maintain the tightened condition of the first pair of eyelets. This procedure is repeated again and again until the lace has been used to tighten each pair of eyelets. Upon reaching the last pair of eyelets the user then attempts to quickly tie the ends of the lace together and preserve the tightness of the lacing, before the instep flaps have had a chance to move apart through slippage between the lace and the eyelets.

This method has some drawbacks. First, it is difficult to pull the laces tightly at the eyelets. In addition, as the user attempts to tighten each pair of eyelets with the lace, the lace can slip in one or more pairs of eyelets that were tightened earlier, permitting the instep flaps to move apart and the boot to thus become relatively loosened. There is no structure known presently which permits one to pull the lace at a particular eyelet, and then to prevent the lace from slipping or retreating backwardly, other than for the user to maintain his or her grip on the lace.

In addition to the method described above, various other methods have been attempted for tightening laces. For example, some people use a mechanical "pick" or "puller" to gain a better mechanical advantage on a lace, and thus be able to pull it tighter. Even with this system, however, when force pressure is released on the particular portion of the lace being pulled, the lace can slip or retreat back in an eyelet to a relatively looser portion.

Another difficulty which often faces one trying to tighten one's boot laces is the frictional resistance on the movement of the lace caused by the frictional engagement between the lace and the tongue, especially in the region where the lace becomes sandwiched between the eyelet-containing instep flaps of the shoe and the tongue.

SUMMARY OF THE INVENTION

The present invention provides a lacing aid to assist in lacing two elements tightly together. A lacing aid of the invention comprises a first portion that is, preferably, easily threaded and engages a lace with reduced friction, and a second portion for restraint of the threaded lace. The first portion preferably forms an opening larger than the lace, and the second portion provides frictional engagement or clamping of the lace.

Lacing aids of the invention may preferably be formed by bending smooth and stiff but resilient wire to form a first portion providing an opening larger than a lace with smooth inner walls, permitting the lace to slip easily when it is being tightened, and a second lace restraining portion formed adjacent to the first portion to which a tightened lace may be easily slipped and engaged. In one form, such a lacing aid can comprise a smooth wire bent to form a lace opening significantly larger than the lace and an adjacent narrow channel for gripping the lace. In preferred such lacing aids, the narrow channel formed by the second portion opens into the lace opening and extends outwardly from one side of the lace opening, for example, being formed by bending a wire back on itself to provide an intervening channel located at the side of the lacing aid. Such lacing aids can also be mitten-shaped with the first open portion corresponding to the palm/finger portion of the mitten-shape and the second lace-restraining portion corresponding to the thumb portion of the mitten-shape. Such lacing aids can have other forms; for example, the second channel-forming portion can extend outwardly from the first open portion forming a T-like, or comma-like shaped lacing aid. In another form, the lacing aid can have a curlicue form with the first portion comprising a large opening of a curlicue and the second portion being formed by an overlapping a smaller portion of the curlicue providing adjacent lace-engaging surfaces. In preferred forms, the second lace-restraining portion is contiguous with the first opening portion so that after a lace has been pulled to tighten the lacing aid and the element to which it is attached, the lace may be easily slid into restraining engagement with the second portion to retain the lace in the tightened position that has been achieved.

The invention also includes an eyelet-connecting means that may be used to fasten an eyelet, such as a lacing aid of the invention, to a substrate element. The connecting means can be formed by two legs projecting from a junction, with one of the legs including a sleeve for rotatably carrying a first portion of the lacing aid or other eyelet-forming means and with the distal ends of the legs providing means for fastening the lacing aid or eyelet to a substrate, such as pair of mating fasteners, one mate being carried by each of the legs. The leg including the sleeve is preferably provided with detent-forming means to hold the eyelet being carried so it extends upwardly and away from the leg. Such a connecting means, or substrate engaging means, preferably comprises thin sheet steel bent into a U-shape, with one of the legs of the U being stamped to form notch-like portions and bent adjacent the notch-like portions to form a sleeve sized to engage the first portion of the lacing aid with a snap-fit so the first portion of a lacing aid is captively, but rotatably, carried by the U-shaped clip and can be held upwardly away from connecting means for easy threading. The extremities of the legs of the U-shaped member can carry mating fasteners, one leg being punched to carry a captive screw and the other leg being punched to form a receiving hole for the captive screw. Such a substrate engaging means can permit lacing aids of the invention to be added to existing footwear by sliding the open end of the U-shaped member over the eyelet-carrying flap of the footwear and engaging the mating fasteners at the ends of the legs through the existing eyelets of the footwear thereby fastening the lacing aid in rotatable engagement with the footwear.

Thus, a lacing aid of the invention can comprise an eyelet for use in the lacing the element together including a first portion for sliding engagement with a lace, a second portion for restraint of a lace, with the first and second portions of the lacing aid cooperating so that a lace be easily engaged with the second portion after it is tightened, and a third portion connected to the first and second portions and adapted for engagement with a substrate, such as the instep flaps, of footwear. The third portion can provide connecting means for connecting a lacing aid to footwear so the first and second portions provide lacing means, with the first portion permitting a lace to be easily tightened in a relatively friction-free manner, and the second portion permitting the lace to be restrained in such a manner as to substantially resist movement of the tightened lace.

The invention thus provides a lacing aid that can be fitted to all kinds of footwear, such as shoes, skates and boots, either when the shoe, skate or boot is originally manufactured, or after manufacture by retrofitting existing shoes, skates and boots to provide the advantages of the lacing aid of the invention to existing skates and boots.

For example, with the invention, it requires less effort to tighten skates than prior lacing systems, permitting young children to tighten and maintain the desired tightness of the skates without the aid of adults. Another advantage of the invention is that by fitting a pair of skates or boots with a complete set of the such lacing aids in the eyelet pairs extending from the toe area of the shoe to the ankle area, the eyelet pairs and the adjacent footwear portions can be individually tightened and maintained in their selected tightness by the second lace restraining portions of the lacing aids, thus enabling a user to customize the tightness of the footwear and to correct for misfitting portions of the footwear.

The invention thus can permit a footwear user ease in lacing and tightening the laces of his footwear and in maintaining the desired tightness of eyelet pairs and equally fast unlacing of his footwear.

These and other features and advantages of the present invention will be apparent to those skilled in the art upon consideration of the drawings, and the more detailed description of the invention that follows.

BRIEF DESCRIPTION OF THE DRAWINGS

FIGS. 11A–11C illustrate a presently preferred embodiment of a lacing aid of the invention;

FIGS. 13A and 13B are a pair of perspective views of the preferred connecting means, and FIG. 13C is a plan view of a stamped sheet from which the connecting means is formed. FIG. 13D is a view from above the connecting means; FIG. 13E is a view from the side of connecting means; FIG. 13F is a view from below the connecting means; FIG. 13G is a cross-sectional view of the connecting means taken at a vertical plane through line 13G—13G of FIG. 13D; and FIG. 13H is an enlarged detail view of the eyelet-engaging portion of the connecting means;

DETAILED DESCRIPTION OF THE INVENTION

Figure 1:
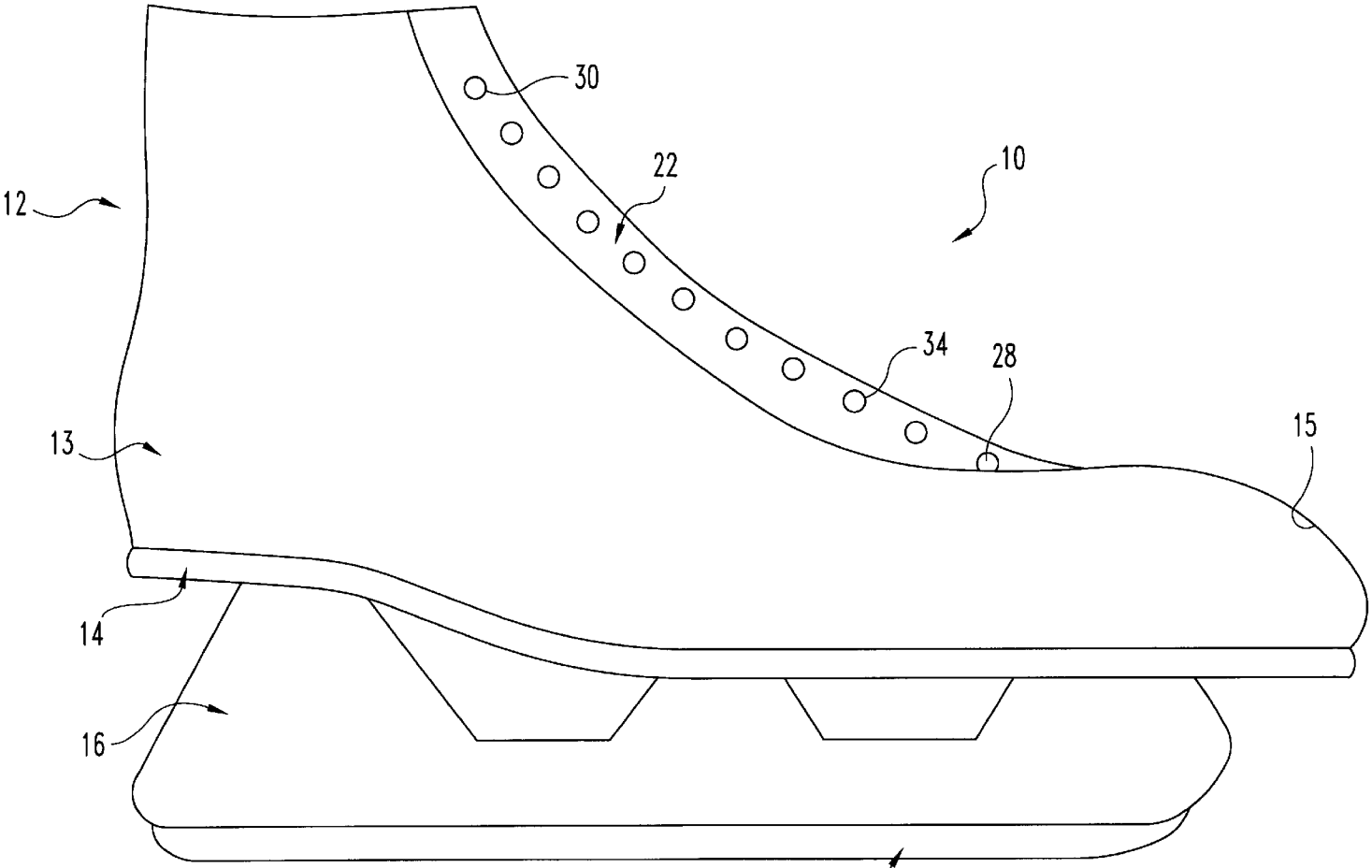
Fig. 1 (PRIOR ART)
FIG. 1 is a side view of a prior art ice skate.
Figure 2:
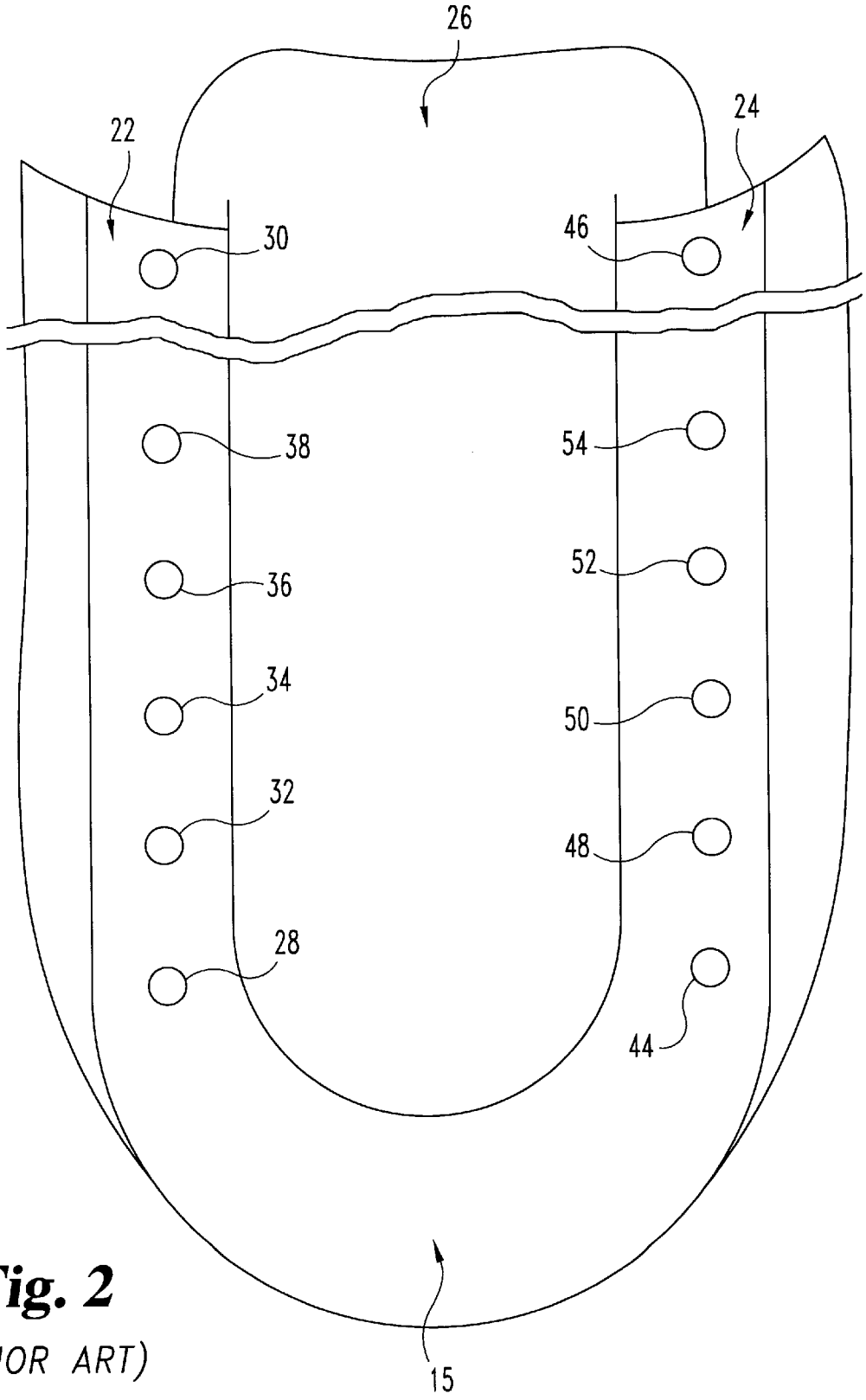
Fig. 2 (PRIOR ART)
FIG. 2 is a top view, partly broken away, of the top of the prior art skate of FIG. 1, showing the first and second eyelet containing flaps, and the eyelets contained thereon.

As best shown in FIGS. 1 and 2, a prior art ice skate 10 (here shown as an ice skate sized for fitting on a user's right foot) includes a boot portion 12 having a heel 13, a sole member 14 and a toe portion 15. The boot portion 12 uses sole 14 to engage a platform 16, the other end of which is attached to a blade 18 for engaging the ice. The boot portion 12 of the ice skate includes a lateral instep flap 22 and a medial instep flap 24 which extends along the instep portion of the boot portion 12, (and adjacent the top surface of the user's foot) from a point slightly removed from the toe 15, to the top surface of the boot portion 12. As best shown in FIG. 2, a tongue member 26 extends between, and partially underlays the lateral and medial instep flaps 22, 24.

Each of the lateral and medial instep flaps 22, 24 include a series of eyelets. As shown in the drawing of FIG. 1, the boot portion 12 of the ice skate 10 includes 11 eyelets on each of the two flaps 22, 24. Although the number of eyelets will vary in different skates, depending upon such factors as size, manufacturer's preference, and skating type (e.g., hockey skate, speed skate or figure skate), the typical number of eyelets contained on a skate are generally between about 5 and 14 or so.

As best shown in FIG. 2, the lateral instep flap 22 includes a distal eyelet 28 which is that eyelet disposed closest to the toe 15 of the skate 10; a proximal eyelet 30, which is the eyelet, disposed furthest away from the toe 15, (and hence, more closely adjacent to the user's ankle); and a series of other eyelets 32, 34, 36, 38 (and others not shown) disposed therebetween. Similarly, the medial instep flap 22 includes a distal eyelet 44, a proximal eyelet 46 and a series of other eyelets 48, 50, 52 and 54 disposed therebetween.

Figure 3:
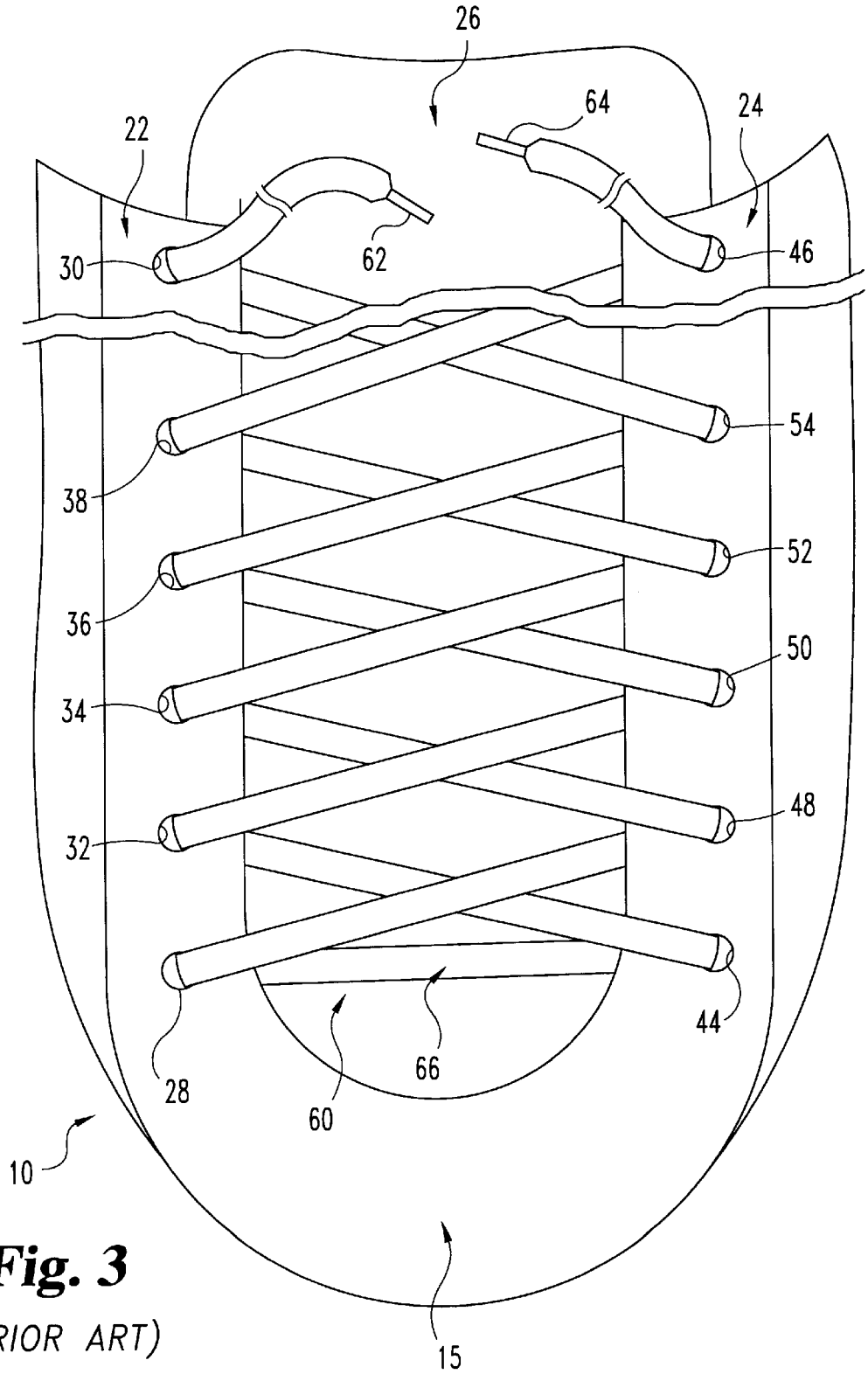
Fig. 3 (PRIOR ART)
FIG. 3 is a top view, similar to FIG. 2, showing a lace engaging the eyelets of the prior art skate.

Turning now to FIG. 3, the skate 10 is shown with a lace 60 engaging the various eyelets 28–54. The lace 60 is generally a continuous lace having a first end 62, a second end 64 and a middle portion 66 which extends through the various eyelets. One generally starts lacing a shoe by passing the first end 62 through the distal eyelet 28, passing the second end 64 through the distal eyelet 44, and then pulling on the respective ends 62, 64, so that the middle of the shoestring 66 is disposed between the two proximal eyelets 28, 44. The first end 62 is then extended across the tongue 26, between the tongue and the interior surface of the medial instep flap 24, and then passed outwardly through eyelet 48. Similarly, the second end 64 is passed diagonally, across 26, passed between the upper surface of tongue 26 and the underside surface of lateral flap 22, and passed outwardly through eyelet 32. This procedure is generally continued until the respective first and second ends 62, 64 emerge from the respective proximal eyelets 30, 46.

If one desires to tighten the skate, the usual manner for doing so is to thread the skate generally as shown in FIG. 3. After threaded (but before being tightened), the fingers are used to engage the underside surface of the laces at points adjacent to the pairs of the lower eyelets, usually either the distal eyelets 28, 44, or the next eyelets 32, 48 of the respective instep flaps 22, 24.

For example, with a finger from her right hand, the user can engage the underside of the lace adjacent to eyelet 32, while with a finger from the left hand the user can engage the lace adjacent to eyelet 48. The fingers then engage the lace and pull the lace outwardly in such a manner so as to pull the respective instep flaps 22, 24 closer together. After they are pulled sufficiently tightly, the lace is then released, and the fingers of the right and left hand are used to engage the lace at a position adjacent to the next eyelets 34, 50 of the instep flap. Because of the frictional engagement between the laces (such as where they overlay each other in the area adjacent to the middle of the tongue), and the frictional engagement between the lace and the tongue 26 and the underside of the instep flaps, the lace and flaps are not completely free to slide back to their former position when the lace is released. Nonetheless, the pressure exerted on the flaps and lace by the foot in the shoe will cause some slippage of the lace, thus causing the lace to not be as tight as desired.

The procedure described above is continued sequentially along the eyelets, until it is performed on the lace adjacent to the penultimate eyelets, adjacent to the proximal eyelets 30, 46. After the lace is tightened to the penultimate eyelets (not shown), the ends 62, 64 of the lace are then grabbed, and pulled tightly, to finish the tightening job. The lace ends 62, 64 are then tied together in a traditional bow-type knot.

Through the procedure described above, a relatively tight and secure fit can be obtained. However, obtaining such a tight and secure fit requires some work. Substantial effort is required to overcome the frictional engagement between the laces and the skate parts (such as the tongue 26 and instep flaps 22, 24) to tighten the laces significantly. In tightening the flaps, a wearer is not working just to overcome the force exerted by the foot and footwear in its resistance to compression, but is also working to overcome frictional resistance. As such, tightening the skates is more difficult than it would be without this substantial frictional resistance.

On the other hand, this frictional resistance is somewhat helpful as it prevents the flaps and lace from returning completely to their former positions once tightened. However, the frictional resistance still permits substantial slide-back.

It has been the experience of the applicants that young skaters (such as those younger than 9 or 10 years old) often have difficulty tightening their skates to a point that they are acceptable. Further, the older, or infirm who may be afflicted by arthritis, may also have difficulty tightening their skates to an acceptable level. Further, because many skaters, especially hockey skaters, prefer that their skates be especially tight to provide maximum ankle support, even many healthy adults are unable to muster sufficient finger and hand strength to tighten the skates sufficiently to comply with their preferences.

One way to help make it easier to tighten skates by reducing friction is to use round laces, rather than flat laces, as round laces generally have less frictional engagement with the skate than flat laces. However, round laces have the disadvantage of sliding back more easily than flat laces. As such, most hockey skates and figure skates tend to use flat laces.

Figure 6:
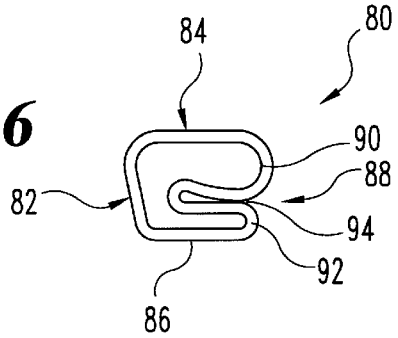
FIG. 6 is a top view of a first embodiment of the lacing device of the present invention.

Turning now to FIG. 6, a first embodiment of the lacing aid 80 of the present invention is shown (in approximately actual size) as comprising a generally mitten-shaped bent wire. The lacing aid 80 includes a shoe engaging portion 82 which is provided for engaging an eyelet engaging member 120 (FIGS. 8 and 9), which, as described below, is provided for engaging one of the eyelets 28–54 of the shoe. The lacing device 80 includes a first lateral leg 84 and a second lateral leg 86. The first and second lateral legs 84, 86 are disposed generally parallel to each other, and generally perpendicular to the shoe engaging portion 82, forming a generally curved, right angle portion between the respective lateral legs, 84, 86 which generally parallels the shoe engaging portion 82.

The lacing device 80 also includes a lace engaging portion 88, which comprises that portion of the lacing device 80 that is disposed generally opposite to the shoe engaging portion 82. The lace engaging portion 88 includes a reduced friction portion 90 through which the lace can move with a relatively reduced level of friction, to promote relatively free movement of the lace therethrough.

The device also includes a lace locking portion 92, which is sized and positioned to snugly engage the lace, to impart a great deal of frictional resistance to the lace by "squeezing it" in the small space, thus making it difficult for the lace to move through the lace locking portion 92.

The lacing device 90 includes a hairpin-shaped bent portion 94 which is disposed between the reduced friction portion 90 and lace locking portion 92, and forms a part of each portion. The hairpin bent portion 94 includes a pair of parallel legs, each of which are generally parallel to the first and second lateral legs 84, 86.

Figure 4:
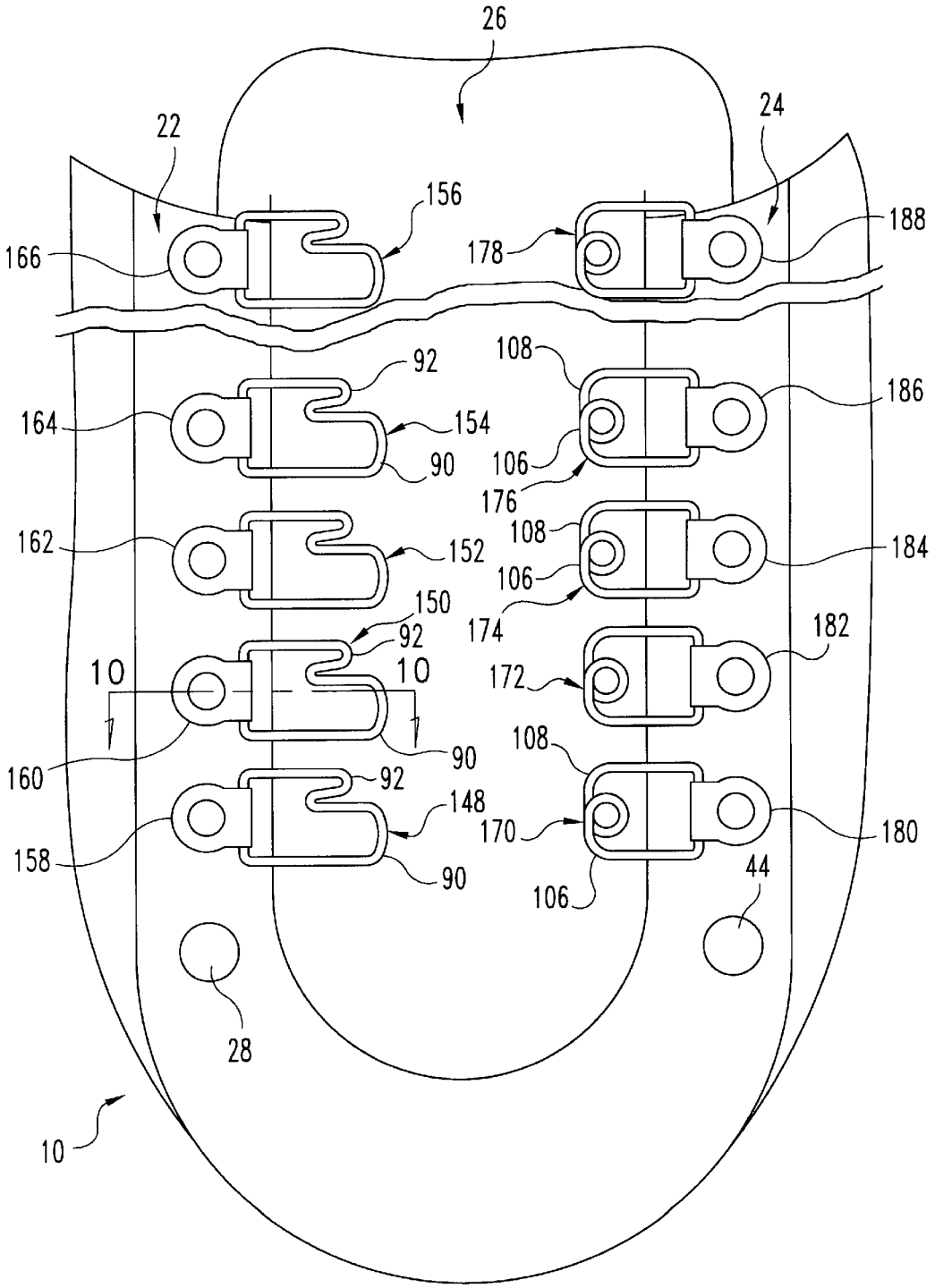
FIG. 4 is a top elevational view, similar to FIG. 2, showing a first and a second embodiment of a lacing aid of the present invention engaged within the eyelets of the skate.

As will be noted, the device 80 has a shape somewhat similar to that of a mitten, wherein the lace locking portion 92 has a relatively smaller thickness, similar to the thumb of a mitten; and the reduced friction portion 90 has a relatively greater diameter (greater thickness), similar to the "fingers portion" of the mitten. Because of this relatively increased diameter of the reduced friction portion 90, when compared to the lace locking portion 92, the lace is less likely to become "squeezed" in this area, and should be able to be threaded and tightened with relative ease. Because of the preferably metal construction of the lacing device 80, the surface of the device 80 are not likely to impart a large amount of frictional engagement with the lace. As will be described in more detail below with respect to FIG. 4, the positioning of both the reduced friction portion 90 and the lace locking portion 92 also aids in reducing the frictional engagement of the lace with the device. As is shown in FIG. 4, the device is designed so that the reduced friction portion 90 overhangs the tongue of the shoe, so that the lace is never sandwiched between the upper side of the tongue 26 and the underside of the instep flaps 22, 24, thus eliminating the frictional engagement caused by this sandwiched arrangement.

Figure 7:
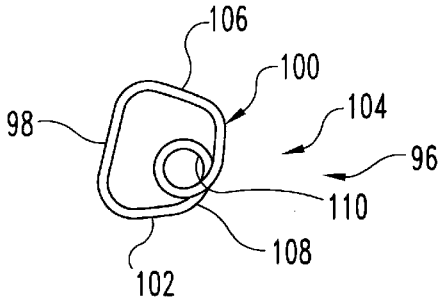
FIG. 7 is a top view of an alternate (second) embodiment of the lacing device of the present invention.

Turning now to FIG. 7, an alternate embodiment lacing aid 96 is shown. Lacing aid 96 includes construction generally similar to lacing device 80, as lacing device 96 comprises a bent or stamped wire curlicue that is formed into a generally endless ring or otherwise has two ends that overlap along the shoe engaging portion 98. Lacing device 96 includes a shoe engaging portion 98 which serves a function generally similar to shoe engaging portion 82. Shoe engaging portion 98 is generally the same size as shoe engaging portion 82. The lacing device 96 shown in FIG. 7, similar to the lacing device 80 shown in FIG. 6, is drawn close to "actual size" of a preferred embodiment. In addition to the shoe engaging portion 98, the lacing device 96 includes a first lateral leg 100 and a second lateral leg 102, which are disposed generally parallel to each other, with both generally perpendicular to the shoe engaging portion 98. Lacing device 97 also includes a lace engaging portion 104 having a reduced friction portion 106, and a lace locking portion 108. A coil portion 110 separates the reduced friction portion 106 from the lace locking portion 108.

The coil portion 110 defines a wedge-shaped lace locking portion 108, which is provided for securely gripping a lace that passes therethrough, and imparting to the lace a great deal of frictional engagement to help prevent the lace from slipping through the lace locking portion 92. The reduced friction portion 90 has a generally greater width, which helps to foster relatively free movement of the lace therethrough.

Figure 8:
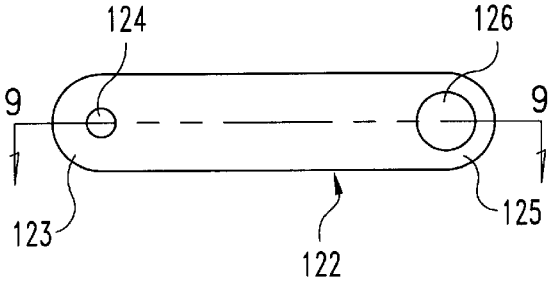
FIG. 8 is a top plan view of a shoe engaging member for connecting a lacing aid of the present invention to a shoe.
Figure 9:
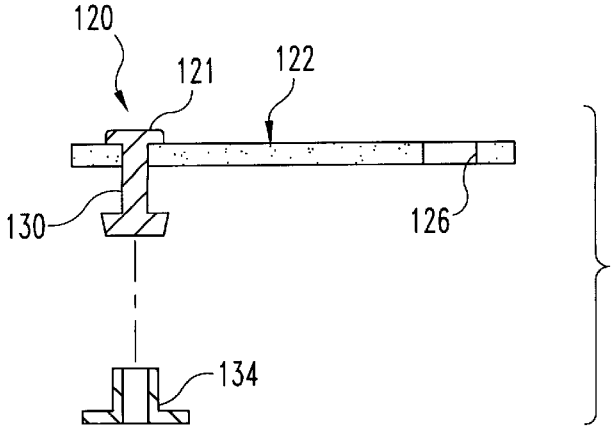
FIG. 9 is a sectional partly exploded view taken along lines 9—9 of FIG. 8.

A connecting means 118 is shown in FIGS. 8 and 9 which is capable of connecting either of the lacing devices 80, 96 to a shoe. The connector means 118 includes an eyelet engaging member 120, which is preferably a medial rivet, and a strap-like lacing aid engaging member 122. The lacing aid engaging member 122 comprises a generally strap-like member having generally flat sides and rounded ends, including a first end 123 and a second end 125. A first aperture 124 for receiving the shaft of the male rivet member 130 is formed at one end of the strap-like device engaging member 122, and a second aperture 126 is formed at the second end of the device engaging member 122. The eyelet engaging member 120 comprises a male, medial rivet member 130 having a head 121 which has a sufficient diameter so as to not be able to pass through aperture 124 and has a bulbous distal end for receiving, and securely engaging the female rivet member 134 when the bulbous head and shaft of the male rivet member 130 are inserted into the central orifice of the female rivet member 134.

Figure 10:
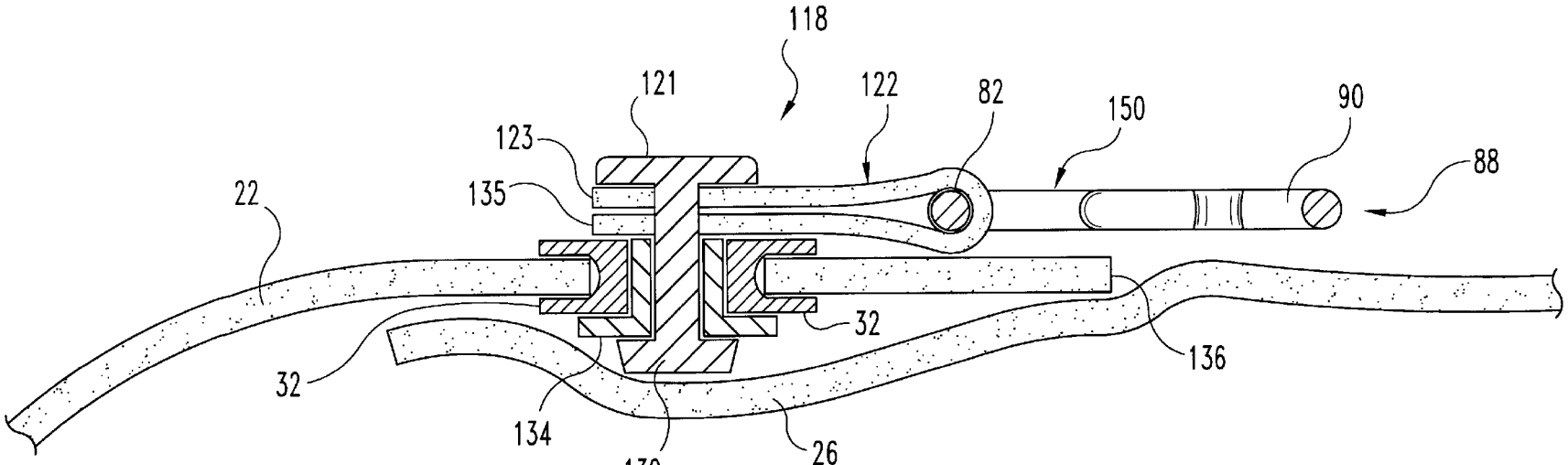
FIG. 10 is an enlarged sectional view taken along lines 10—10 of FIG. 4.

Turning now to FIG. 10, the assembled connector means 118 is shown as it is coupled to an eyelet. In FIG. 10, an eyelet, (which is defined by the grommet 32, that is inserted through an aperture in the lateral flap member 22) is provided for receiving the connecting means 118. The male member 130 of the medial rivet has its shaft inserted through the first aperture 124 of the lacing aid engaging member 122, so that the upper surface of the lacing aid engaging member 122, adjacent to first end 123 is placed adjacent to the underside surface of the head 121 of the male rivet member 130. The lacing aid engaging member 122 is looped around, and is passed around the shoe engaging portion 82 of the lace aid 80 (numbered 150 in FIG. 4), to securely engage the lace aid to the device engaging member 122, and hence the connector means 118. The shaft portion of the male rivet member 130 is inserted through aperture 126 to complete the closed loop, to maintain the lace aid in engagement with the connector 118. The male rivet member 130 is then inserted through the aperture defined by grommet 32. The male rivet member 130 is further inserted through the central aperture of the female rivet member 134, so that the lateral legs of the female rivet member 134 are placed axially inwardly of the bulbous head of the male member 130, to retain the female rivet member 134 in position, and to retain the male rivet member 130 within the grommet 32, and hence the eyelet.

When so positioned, the distal end of the bulbous head of the male rivet member 130 is placed adjacent to the upper surface of the tongue 26 of the boot, and the lace engaging portion 88, including the reduced friction portion 90 of the lace aid numbered 150, is positioned to overlay the upper surface of the tongue 26, and to hang over the inner end 136 of the lateral flap 22.

It will also be appreciated that the connecting means 118 shown and described above can be used as an "add on" connecting means for already existing skates having eyelets. However, standard connecting means, such as the connecting means used to fasten D-ring eyelets to footwear, can also be used to attach lacing aids of the invention to footwear manufactured "OEM" at the factory, without the need for designing them as retrofits.

Turning now to FIG. 4, FIG. 4 shows a boot top, similar to that shown in FIGS. 2 and 3, where the lacing aids of the present invention have been used. As is shown in FIG. 4, the distal eyelets 28, 44 of both the lateral flap 22 and medial flap 24 do not have a lacing aid inserted therein. Lacing aids are frequently not necessary in the eyelet pair nearest the footwear toe because this portion of the footwear rarely requires tightening. However, in the embodiment shown in FIG. 4, a series of lacing aids numbered 148, 150, 152, 154 and 156 and accompanying connecting means 158, 160, 162, 164 and 166 are shown as being attached to the eyelets 28–38 of the lateral flap member 22. It will be noted that each of the lacing devices 148–156 that are attached to lateral flap member 22 are the lacing devices of the embodiment first described above, and are generally mitten-shaped, with the "thumbs" 92 of the mittens being preferably disposed relatively closer to the top end of the boot 10. Put another way, the reduced friction portions 90 are preferably disposed toward the toe at the boot.

Each of the lacing aids numbered 148–156 in FIG. 4 are generally identical to lacing aid 80 shown in FIG. 6. Similarly, the connector means 158–166 shown in FIG. 4, are generally identical to connector means 118, shown in FIGS. 8, 9 and 10.

A second series of lacing aids numbered 170, 172, 173, 176 and 178 in FIG. 4 are shown as being attached by respective connector means 180, 182, 184, 186 and 188 to the eyelets 46–54 of the medial flap 24. The lacing aids numbered 170–178 are generally similar to lacing aids 96 shown in FIG. 7.

This illustration of a first embodiment of lacing aids 80 on the lateral flap 22, and a second embodiment of lacing aids 96 on the medial flap 24, is only a convenient illustration of the invention. In practice, it is likely that one would use a single embodiment of lacing aids in the footwear, for example, either all of the "mitten-shaped" lacing devices as shown in FIG. 6, or all of the "curlicue" lacing aids 96 shown in FIG. 7 on any one particular pair of footwear. However, nothing would prevent a user from mixing lacing devices in a manner like that shown in FIG. 4. In addition, nothing would prevent a user from using a plurality of standard D-ring eyelets (for example, in place of lacings aids 148, 150, 152, 154, 170, 172, 174, 176) with only a pair of lacing aids of the invention (Such as lacing aids 156, 178). After tightening a lace through the plurality of D-ring eyelets, the lace can be maintained in its selected tightened condition by the lacing aids (e.g., lacing aids 156, 178).

The lacing devices 170–178 of the medial flap 24 are all positioned preferably so that their locking portions 108 are disposed relatively closer to the top end of the boot, and their reduced friction portions 106 are preferably disposed relatively closer to the toe.

The preferred use of the reduced friction portions 96, 106 closer to the toe of the boot, and the lace retaining portions 92, 108 closer to the top of the boot, aids in the lacing process, as will be described in more detail below with respect to FIG. 5.

Figure 5:
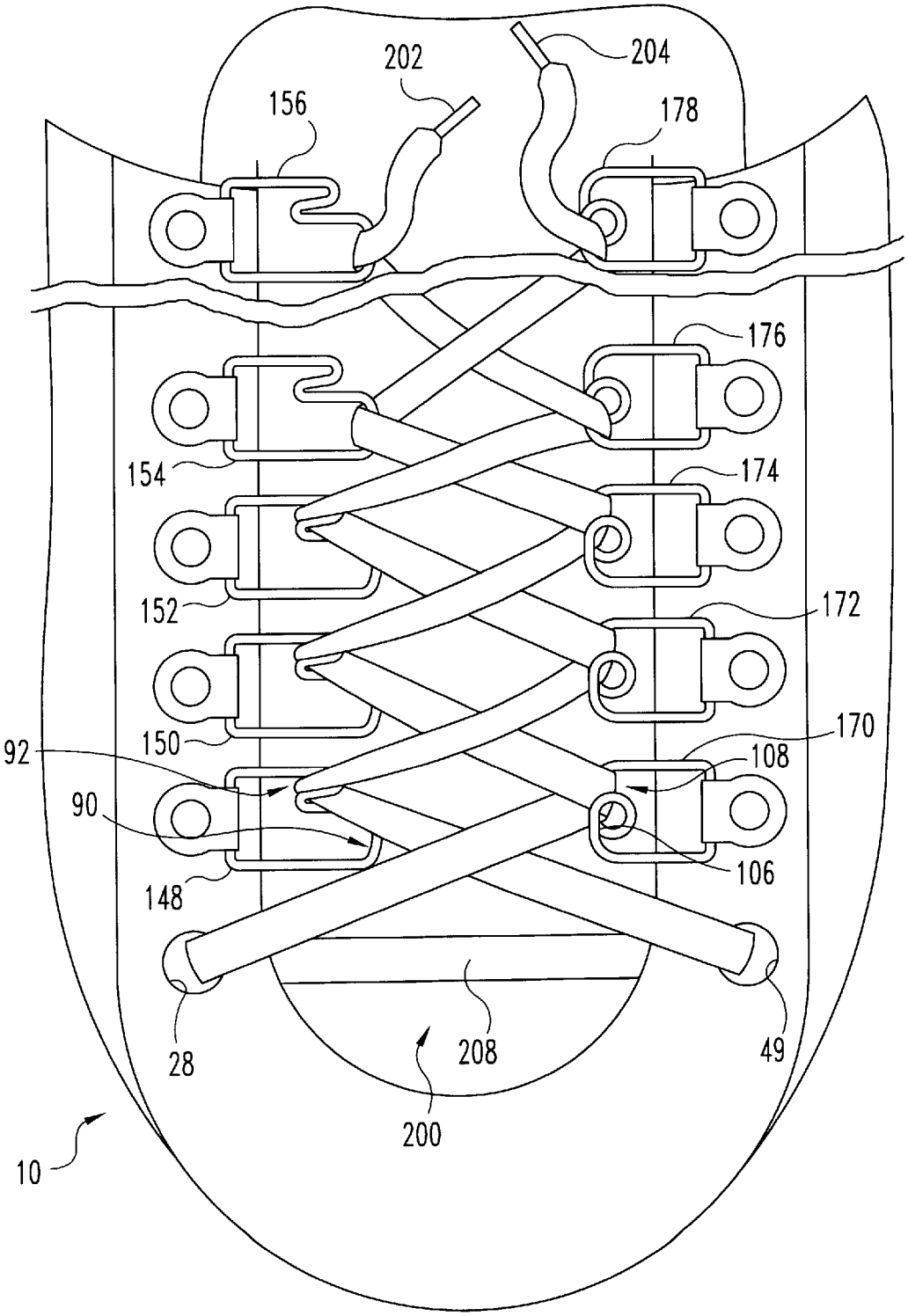
FIG. 5 is a top view of a skate, similar to FIG. 3, showing a lace engaging the first and second embodiments of the lace aids, illustrated in FIG. 4.

Turning now to FIG. 5, a skate boot 10 is shown wherein a lace 200 having a first end 202 and a second end 204, and a middle 208 is laced up into, and extends through the various lacing aids 148–156, and 170–178 of the present invention.

Comparing FIG. 5 to FIG. 3, the lacing configuration is generally similar, with the middle 208 of the lace 200 being placed between the two distal eyelets 28, 44. The lace is then crisscrossed, so that a segment extends between eyelet 44 and lacing device 148; and similarly, a segment extends between eyelet 28 and lacing device 170. The procedure by which the lace is passed through the eyelets is similar to that described above in connection with FIG. 3. The laces are tightened with the tightening procedure beginning at the lacing aids 148–170 closest to the toe and proceeding up the boot to the topmost lacing aids 156, 178.

When the boot is first laced up, the lace is positioned so that it is passed through the reduced friction portions 90, 106 of all of the lacing aids 148–156 and 170–178. To tighten the boot, the user grasps the lace portions adjacent the lacing aids 148 and 170 and pulls the lace portions so the lace slides through the reduced friction portions 90, 106 and pulls the lacing aids and attached flaps toward each other, tightening the flaps of the footwear. While maintaining the tension on the lace, the user then moves the lace portions from the reduced friction portions 90, 106 of the lacing aids to the lace restraining portions 92, 108 so the lace and the footwear flaps are retained in their tightened positions by the lacing aids. The user may then move to the next pair of lacing aids 150, 172 and repeat the tightening procedure by grasping the lace portion adjacent the lacing aids 150, 172 and pulling the lace portions through the reduced friction portions 90, 106 to move the lacing aids 150, 172 and the attached flaps toward each other to a position of tightness, and then moving the lace portions from the reduced friction portions 90, 106 to the lace restraining portions 92, 108 to retain the tightness.

Thus, as illustrated in FIGS. 4–7, a lacing aid of the invention can comprise a first portion, such a portion 90 of the lacing aid 80 of FIG. 6 and portion 106 of the lacing aid 96 of FIG. 7, that provides easy tightening of a lace, and a second portion, such as portion 92 of the lacing aid 80 of FIG. 6 and portion 108 of the lacing aid 96 of FIG. 7, that restrains a lace against movement and retains its tightened condition. As noted from FIGS. 6 and 7, lacing aids of the invention can comprise eyelets formed by bending a single piece of wire into contiguous first and second portions that cooperate to permit ease in lacing and tightening and maintenance of a selected degree of tension when so tightened.

FIGS. 11A through 11C illustrate a presently preferred embodiment of the invention, including a preferred bent wire lacing aid 210. FIGS. 11B and 11C comprise enlarged views showing the formation of the ends of the wire.

The preferred lacing aid, as shown in FIG. 11A, comprises a first portion 211 that may be easily threaded and will impose little restriction to the relative movement of a lace and the lacing aid as a lace is tightened, and a second portion 212 into which a lace may be moved for engagement and restraint against movement. The lacing aid 210 may be formed from a single length of wire which is bent to form the first opening 211*a* by an outwardly extending leg 213 and a transversely but slightly inwardly extending leg 214 to form the first relatively friction-free lace engaging portion. The second lace restraining portion 212 is formed by bending the wire outwardly from the leg 214 in a further outwardly extending leg 215 and doubling the wire back at a sharp bend 216 to form an inwardly extending leg 217 that is substantially parallel to the outwardly extending leg 215 for a fraction of an inch to form a narrow channel 212*a* between the legs 215, 217, at which a lace is clamped and retained. As shown in FIG. 11A, the ends of the wire 218 and 219 are bent inwardly toward each other on a substantially common central axis and form an axle so the lacing aid may be rotatably carried, as described further below. The ends of the wire 218, 219 are further provided with small disk-like terminals 218*a*, 219*a*, preferably by cold-forming the wire ends.

The preferred lacing aid 210 may be formed with smooth wire of hardened steel, for example, 1060 annealed spring steel, aus tempered after forming (34–38 HRC), preferably having a diameter of about 1.8 mm. Legs 213 and 214 can provide an opening 211*a* with a height of about 6 to 8 mm., preferably about 7.1 mm., and a width of about 8 to 12 mm., preferably about 10 mm. (an open area of about 48 to 96 sq. mm., preferably about 70 sq. mm.). Legs 215 and 217 can form a channel 212*a* with a width of preferably about 0.7 mm. and a length of about 5 to about 7 mm. The cold-formed ends 218*a* and 219*a* provide at their outmost transverse surfaces, engagement surfaces for the connecting means illustrated in the FIGS. 13 that are transverse to the axis of rotation formed by ends 218, 219. In the lacing aid of FIG. 11A, the outermost transverse surfaces are spaced a distance 220 of about 2 to 3 mm., preferably about 2.5 mm., and the ends 218*a* and 219*a* can be separated a distance 221 of about 0.3 mm., as shown in FIG. 11B. As shown in FIG. 11C, the ends 218*a* and 219*a* are offset at about 45 degrees by a small distance 222, for example, about 2 mm. The cold-formed ends prevent the lacing aid 210 from separating from the connecting means in use.

Figure 12A:
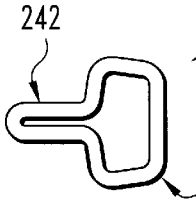
FIGS. 12A through 12E are plan views of other forms of lacing aids of the invention.
Figure 12B:
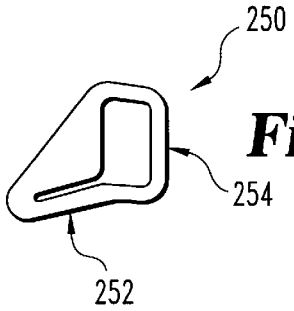
Figure 12C:
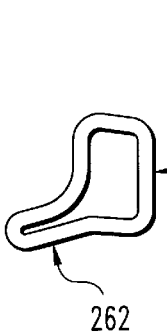
Figure 12D:
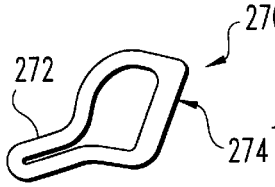
Figure 12E:
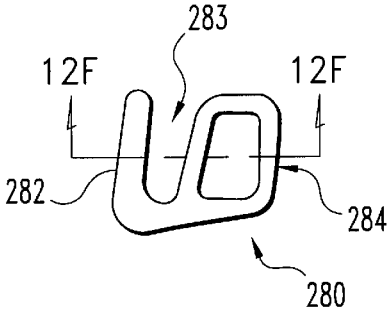
Figure 12F:
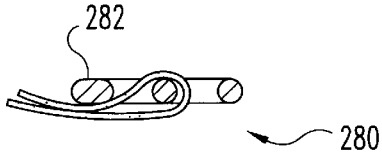
FIG. 12F illustrates a use of the lacing aid of FIG. 12E.

The preferred lacing aid 210 of FIGS. 11A–11C differs from lacing aid 80 of FIG. 6 primarily by its departure from the mitten-like appearance of lacing aid 80 in that its second lace-restraining portion 212 extends outwardly from its first open portion 211 rather than lying adjacent to it as the first and second portions 90 and 92 lie in lacing aid 80 of FIG. 6. Lacing aids of the invention may take still other forms as illustrated by FIGS. 12A–12E. In the lacing aid 240 of FIG. 12A, the second lace restraining portion 242 extends outwardly from the central portion of the first open portion 244 in a T-like shape, and in the lacing aids 250, 260 and 270 of FIGS. 12B, 12C and 12D, respectively, their respective lace restraining portions, 252, 262 and 272, respectively, extend outwardly and slightly angularly from their respective open portions 254, 264 and 274 in a comma-like shape. In the lacing aid 280 of FIG. 12E, the second lace restraining portion 282 is formed by a hook-like portion 282 forming a channel 283 that does not open into its first open portion 284. In using the lacing aid 280, a lace is moved into channel 283 and under hook-like portion 282 after it is tightened, as indicated by FIG. 12F.

Figure 14:
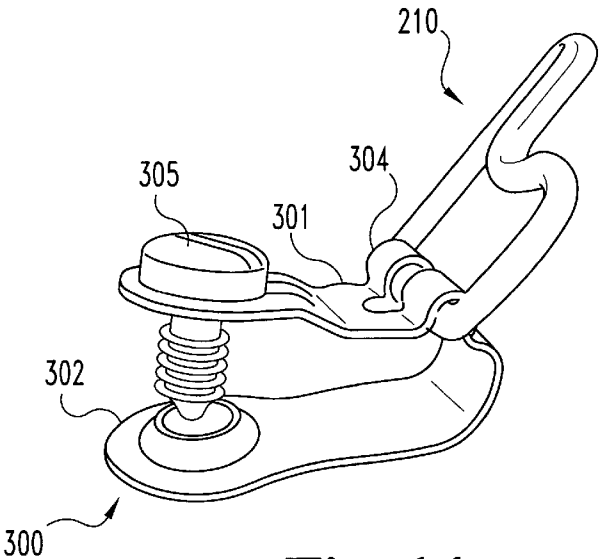
FIG. 14 is a perspective view of the connecting means of FIGS. 13A–H assembled with a lacing aid.
Figure 13B:
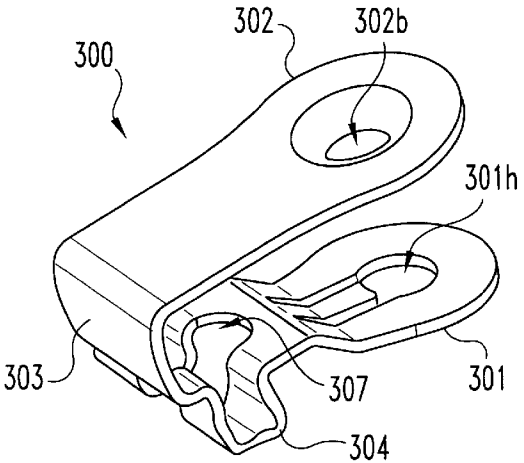
FIGS. 13A through 13H illustrate a preferred connecting means, or a substrate-engaging means for the attachment of lacing aids of the invention, and other eyelet-forming means such as standard D-rings, to elements to be laced together.
Figure 13A:
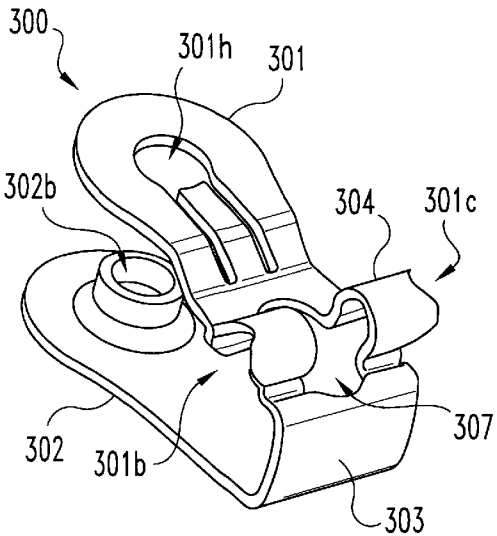
Figure 13H:
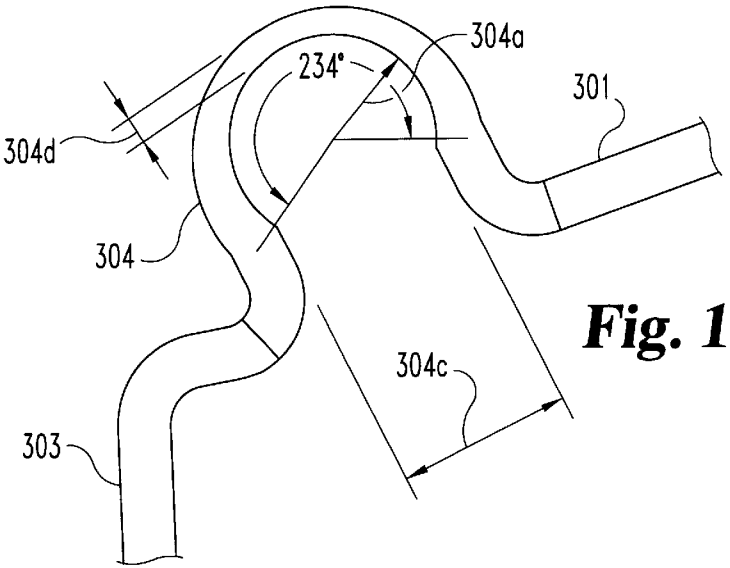
Figure 13C:
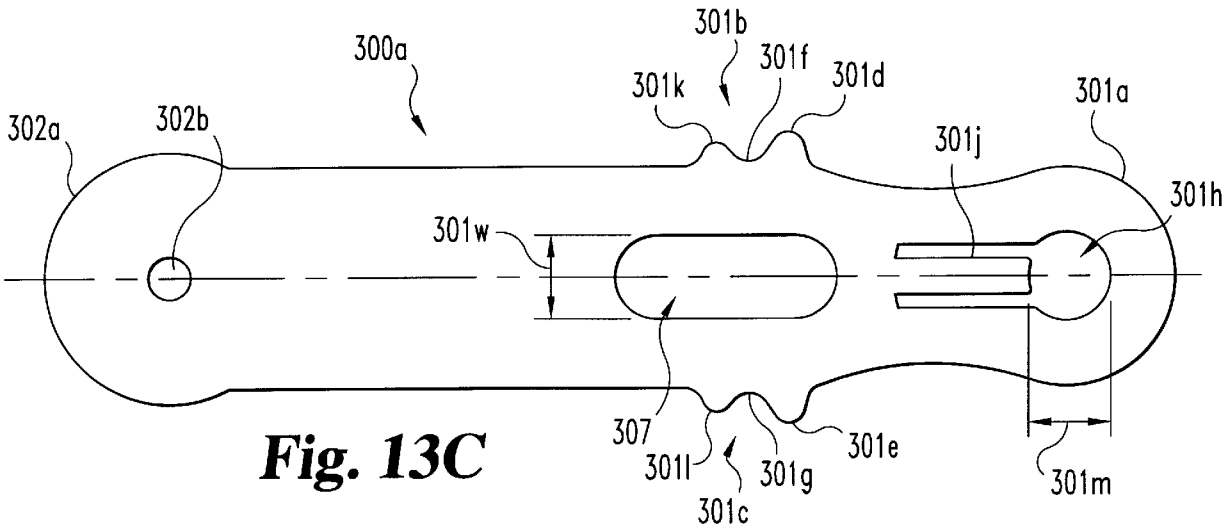
Figure 13G:
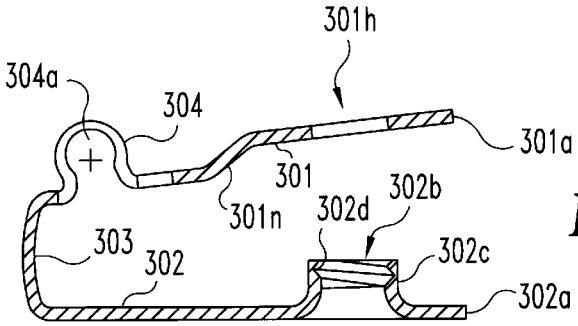
Figure 13D:
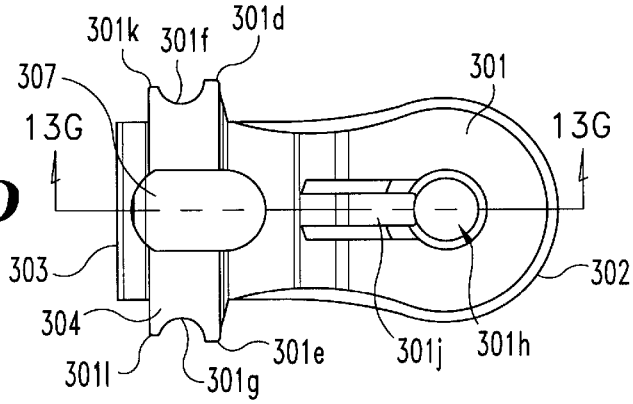
Figure 13E:
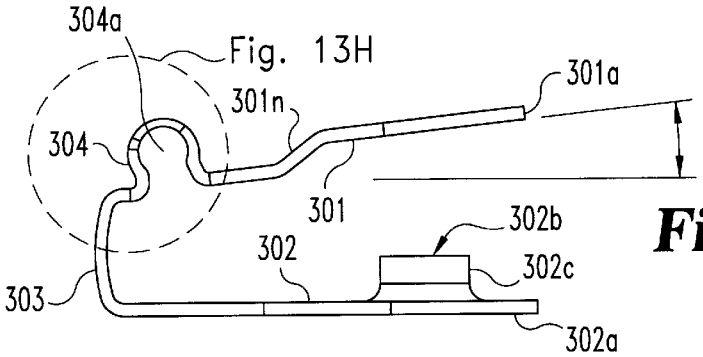
Figure 13F:
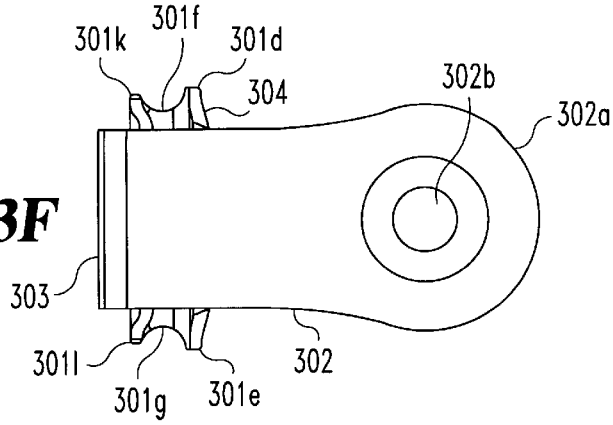

FIGS. 13A through 13H illustrate a preferred connecting means, or substrate-engaging means, 300 for the attachment of lacing aids of the invention, and other eyelet-forming means such as standard D-rings, to elements to be laced together. FIGS. 13A and 13B are a pair of perspective views of the connecting means 210 and FIG. 13C is a plan view of a stamped sheet 300*a* from which the connecting means 300 is formed. FIG. 13D is a view above the connecting means 300; FIG. 13E is a view from the side of connecting means 300; FIG. 13F is a view from below the connecting means 300; FIG. 13G is a cross-sectional view of the connecting means 300 taken at a vertical plane through line 13G—13G of FIG. 13D; and FIG. 13H is an enlarged detail view of the eyelet-engaging portion of the connecting means 300. FIG. 14 is a perspective view of a connecting means 300 assembled with a lacing aid 210.

As illustrated in FIGS. 13A, B, D–H, the connecting means, or substrate-engaging means, 300 comprises a U-shaped element formed from thin sheet steel 300*a* (FIG. 13C) with a pair of legs 301, 302 extending outwardly from a U-junction 303, a small U-shaped bend 304 extends upwardly from and across one of the legs 301 as shown, and the distal ends 301*a*, 302*a* of legs 301, 302 provide a pair of mating fasteners. (See FIG. 14.) Preferably, a threaded screw 305 is carried by leg 301 and a complimentary opening 302*b* is formed in leg 302 with threads 302*d* to receive the threaded portion of screw 305. In addition, the edge portions 301*b*, 301*c* of leg 301 are formed to provide a stop by projections 301*d* and 301*e* and a detent by notch portions 301*f* and 301*g*. When the connecting means 300 is assembled with an eyelet element, such as a lacing aid 210, shown in FIG. 14, the side portions of the eyelet (e.g., legs 213 and 217 of lacing aid 210) engage the notch portions 301*f* and 301*g* and the eyelet is held to extend upwardly away from the connecting means 300 as shown in FIG. 14. Edge portions 301*b*, 301*c* prevent the eyelet from lying adjacent leg 301.

The connecting means 300 of FIGS. 13A–13H is formed from thin stamped sheet metal 300*a*, for example, 1050 spring steel which is about 0.5 mm. thick and aus tempered (34–38HR). The end 301*a* is punched to form a hole 301*h* and a tab 301*j* that deforms to engage and retain screw 305 in leg 301. End 302*a* is punched to form a hole 302*b* and deformed, as at 302*c*, to provide a thread-engaging surface 302*d* for screw 305. In addition, the sheet metal form 300*a* is stamped centrally (in the area to form the U-shaped bend 304) to provide an opening 307 to receive the disk-like terminations 218*a* and 219*a* upon assembly of the lacing aid 210 in the connecting means 300. The edge portions 301*b*, 301*c* of the form 300*a* are stamped to form the stop projections 301*d*, 301*e* and the adjacent notch portions 301*f*, 301*g* where the U-shaped bend 304 will be formed. The form 300*a* is bent to form the U-shaped connecting means 300 with legs 301 and 302 extending outwardly from U-junction 303. In addition, the U-shaped bend 304 is formed to provide an upwardly extending sleeve 304*a* that is sized to engage the straight axle-like portions 218–219 with a snap-fit into the U-shaped bend 304 and to rotatably retain the lacing aid 210 therein by the resilience of its metal. As indicated by FIG. 13H, the U-shaped bend may be gradually thinned over about 234 degrees, with a minimum thickness 304*d* of about 0.2–0.3 mm. Assembly of a lacing aid 210 into the connecting means 300 is indicated by FIG. 14 wherein the axle-like portions 218, 219 of the lacing aid 210 have been inserted between legs 301, 302 of the U-shaped element 300 and positioned with its disk-like elements 218*a*, 219*a* adjacent opening 307 and is pressed upwardly into snap-fit engagement with the U-shaped bend 304, which rotatably retains the lacing aid 210 and the connecting means 300 in an assembly usable to fasten the lacing aid to a substrate, such as the instep flaps of footwear. As indicated in FIG. 14, the sides 213 and 217 of the lacing aid 210 will engage the notch portions 301*f*, 301*g* of the connecting means 300, and the lacing aid 210 will be retained in an upright position so that opening 211*a* may be easily threaded with a lace.

The stamped form 300*a* from which connecting means 300 is formed is 1050 spring steel, aus temper (34–38 HRC) as indicated above, with a width of preferably about 7.6 mm to about 8.6 mm and a length of about 44 mm. the form 300*a* is provided with an opening 307 having a width 301*w* of about 3.5 mm and a length of about 5.5 mm. The sides of form 300*a* are formed with a pair of projections 301*d*, 301*e* that extend outwardly from the sides of form 300*a* adjacent hole 307 a distance of about 1.3 mm. and a further pair of projections 301*k*, 301*l* that extend outwardly from the sides of form 300*a* adjacent hole 307 a distance of about 0.9 mm. Notch-like detent surfaces 301*f* and 301*g* are formed between projections 301*d* and 301*k* and 301*g* and 301*l*, respectively. Preferably, projections 301*d* and 301*e* are formed with radii of about 0.8 mm; projections 301*k* and 301*l* are formed with radii of about 0.6 mm; and detent surfaces 301*f* and 301*g* are formed with radii of about 0.9 mm. The opening 301*h* has a radius for carrying flat head 6-32 machine screw 305, e.g., about 1.8 mm, but the tab 301*j* terminates at a distance 301*n* of about 3.2 mm and can thus engage and retain a 6-32 machine screw in hole 301*h*. The centers of openings 302*b* and 301*h* are separated a distance of about 35.2 mm, and hole 307 extends from a distance of about 17.5 mm from the center of hole 302*b* to a distance of about 26.5 mm from the center of hole 302*b*. Hole 302*b* is pierced into a deformation 302*c* which is threaded to receive a 6-32 machine screw. Form 300*a* is bent at the U-junction 303 to provide a spacing of about 4.4 mm between legs 301 and 302 at U-junction 303, and leg 301 preferably extends upwardly and slightly away from parallel to leg 302 by a small angle, such as 7.5 degrees. Leg 301 is further bent to form sleeve-like portion 304 with an inner radius 304*a* of about 1 mm over an angle 304*b* of about 234 degrees and an opening 304*c* into the sleeve having a width of about 1.8 mm. Leg 301 may be further bent to form an offset 301*n* between the sleeve portion 304 and its distal end 301*a*.

An assembly, including a lacing aid 210, or standard D-ring, may be easily fastened to footwear by sliding the open ends 301*a*, 302*a* of the U-shaped element 300 over the inside edge of one of the flaps 22, 24 (shown in FIG. 2) forming a shoe opening, inserting the shank of the threaded screw 305 through one of the eyelets 28, 32, 34, 36, 38, 40, 44, 48, 50, 52, 54, 56, and tightening it into the thread-receiving portion to fasten the lacing aid to the shoe flap. Such a connecting means 300 when attached to a footwear flap with a lacing aid 210 of the invention, or with a standard D-ring, holds the lacing aid or D-ring outwardly from the footwear so it may be easily threaded and laced, prevents twisting of the connecting means as a lace is tightened and aids in preventing the screw from working loose.

The invention thus provides an inexpensive lacing aid and an inexpensive method of forming such a lacing aid by the use of a single piece of wire, by bending the wire to form a first open loop or eyelet and a second contiguous clip-like portion. In addition, the method provides a convenient, inexpensive means for connecting such a lacing aid or other eyelet-forming means to footwear by the formation of the thin sheet strip bent to provide a U-shaped element with one of the legs of the U-shaped element being further bent to provide a sleeve sized to rotatably capture a wire-formed lacing aid and being stamped to releasably locate such a lacing aid for easy lacing.

Figure 15:
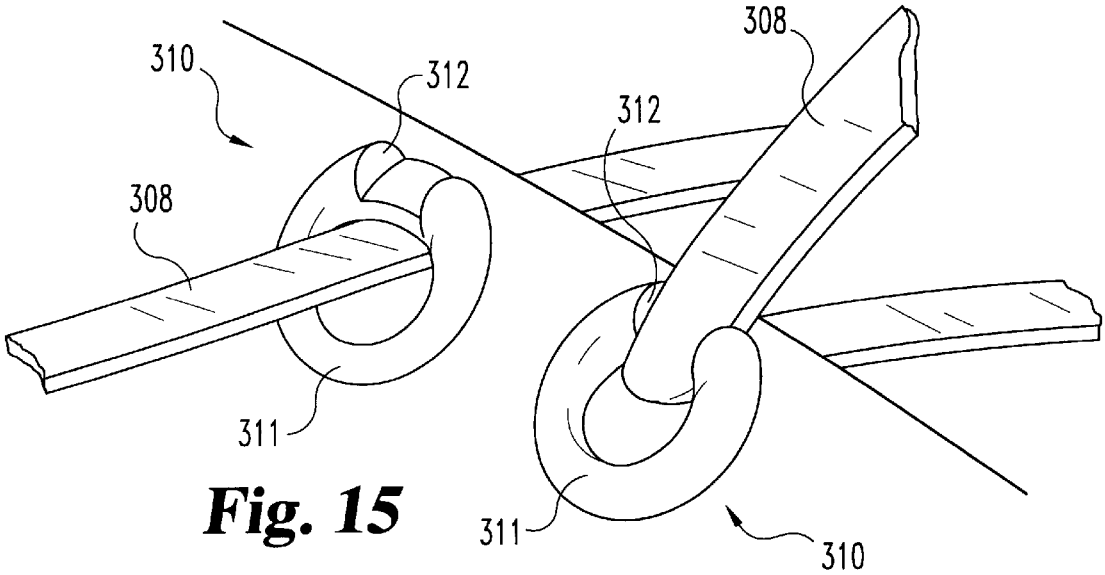
FIG. 15 is an alternate embodiment of a lacing aid of the invention.
Figure 16:
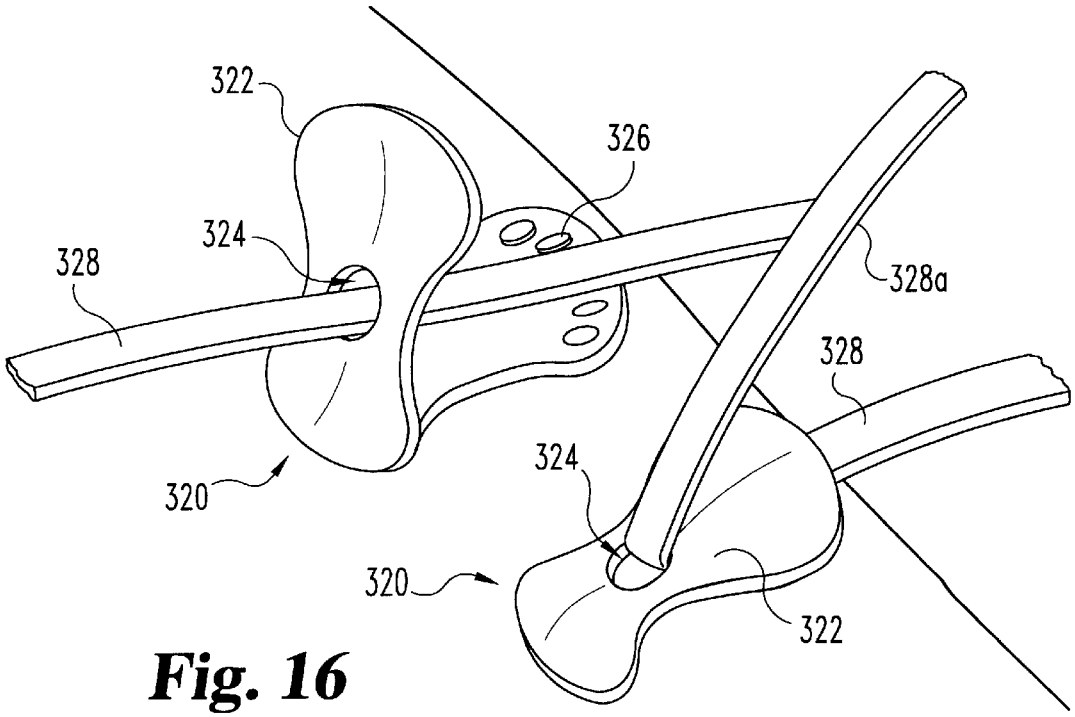
FIGS. 16, 17A, 17B, 18A, and 18B illustrate embodiments of lacing aids of the invention with a moving part.

Although the preferred lacing aid may be formed in one piece from a wire, less preferred lacing aids of the invention may be formed by other means. FIG. 15 illustrates an alternate embodiment 310 in the form of an eyelet having a first portion 311 forming an opening and a second lace-restraining portion 312 formed by a thickened portion of the eyelet which has been channeled to provide edge surfaces to frictionally engage a lace 308. As illustrated at the left of FIG. 15, a lace can be threaded through the open portion 311 of the eyelet, and after the lace is tightened or adjusted, the lace can be inserted into the channeled portion 312 and engaged with the restraining edge surfaces. FIG. 16 illustrates a lacing aid of the invention with a moving part. The lacing aid 320 of FIG. 16 is formed from a thin sheet bent into a "V" and includes a first portion 322, forming an opening 324 through which a lace 328 is threaded and a second lace-restraining portion 326, which in combination with the first portion 322 forms a clamp for the lace 328. As indicated in the lower portion of FIG. 14, as the end 328*a* of lace 328 is tightened, lace 328 bears downwardly on the first portion 322 and clamps the lace 328 between the first and second portions 322, 326.

Figure 17A:
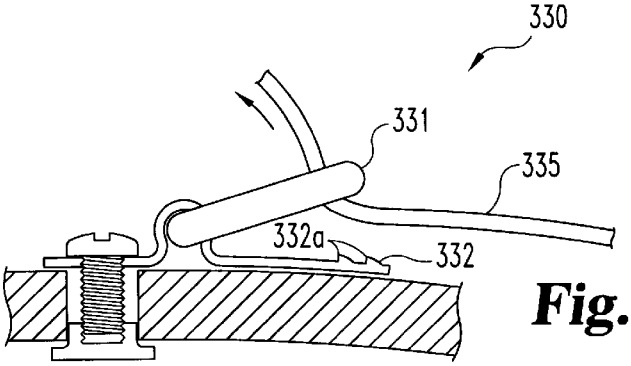
Figure 17B:
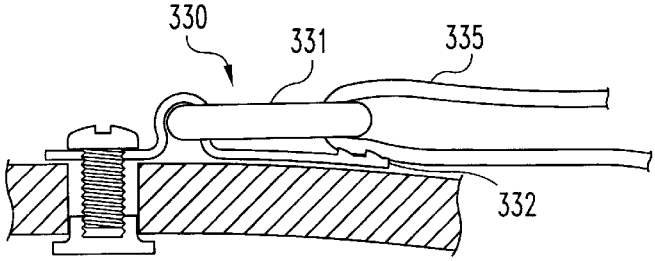
Figure 18A:
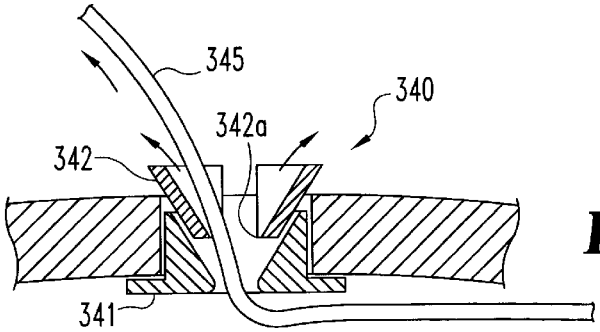
Figure 18B:
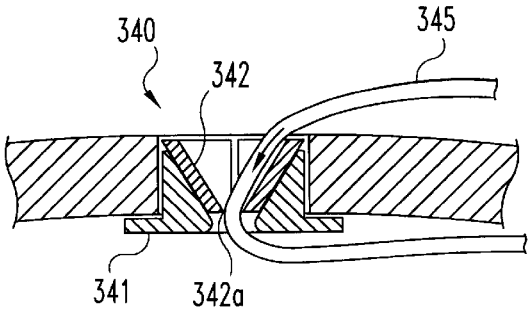

FIGS. 17A and 17B illustrate a further lacing aid 330 of the invention with a moving part. The lacing aid 330 includes a first portion 331 forming an eyelet, such as a standard D-ring and a second portion 332 forming a lace-restraining portion, which in combination with the first portion 331 restrains a lace 335 from movement after it is tightened. As indicated by FIG. 17B, as lace 335 is tightened, it pulls the first portion 331 downwardly against the second portion 332 forcing the lace into engagement with one or more lace-restraining edges 332*a*. FIGS. 18A and 18B illustrate a still further lacing aid 340 of the invention with a moving part. The lacing aid 340 includes a first portion 341 forming an eyelet and a second part 342 forming a lace-restraining portion which, in combination with the first part 341, restrains a lace 345 from movement after it is tightened. As indicated in FIGS. 18A and 18B, the second portion 342 is split frustoconical inner part which moves in a mating frustoconical eyelet-forming means 341, and, as shown in FIG. 18A, as a lace is being tightened, part 342 is moved upwardly so it does not interfere with the tightening movement of the lace 345, but part 342 is moved into engagement with part 341 if the lace 345 tries to move backwardly (in the direction of the arrow) and part 342 is squeezed downwardly and inwardly into engagement with the lace 345 where its lace-engaging edges 342*a* bites into the lace, restraining it from movement.

The lacing device of the present invention provides several advantages, over prior art. Such lacing aids permit any two elements connected by a lace to be laced together easily with a selective tightness that is easily maintained.

For example, one advantage of the present invention is that the lacing aid can be fitted to skates and boots. The lacing aid can be designed as original equipment, that is, manufactured, for example, as part of the skating boot or, alternately, can be provided as a retrofit part which is designed to engage existing eyelets of skates and boots.

Another advantage of the present invention is that it permits less effort to be used to tighten footwear than prior known lace engaging systems, such as eyelets. According to one test run by the applicants, the lacing aid of FIG. 6 requires up to 60 percent less effort to achieve a certain tightness, when compared to conventional round eyelet-only systems. This advantage enables some persons who are unable to sufficiently tighten their footwear, without help, to do so without requiring assistance. This is especially advantageous to young children and their parents.

An important advantage is that the lace-restraining portion of lacing aids of the invention helps to prevent a lace from sliding backwardly from a desired tightened condition, and thus loosening up the tightened elements. The invention enables a user to better customize the tightening of a boot or skate by applying and maintaining a desired tension at each portion of the footwear flaps. This enables the user to tighten some footwear portions more tightly and maintain the desired tightness, but to allow other footwear portions to be more loose. The invention will also enable a user to lace and unlace their skates more quickly by placement of the lace into the reduced friction portions of the lacing aids.

While the preferred embodiment of the lacing aid is formed by a bent single length of wire, lacing aids of the invention may be formed by other methods such as stamping, die casting and the like. In addition, while lacing aids of the invention may be provided with the connecting means described above for attachment to elements such as the instep flaps of existing footwear, lacing aids of the invention may be attached to elements by existing means, such as the connecting means currently in use to attach standard D-ring eyelets to footwear.

While we have described the presently preferred embodiment and a number of alternative embodiments, those skilled in the art will recognize that other forms and embodiments of the invention may be devised without departing from the scope of the following claims.

We claim:

1. A lacing aid, comprising:

a first portion forming an opening larger than a lace that promotes slippage between a lace and the lacing aid;

a second lace-restraining portion having a narrow channel extending from said opening for frictional engagement of a lace; and a U-shaped substrate-engaging portion having two legs and a curved portion between said legs, said lacing aid being rotatably connected to said curved portion of said substrate-engaging portion, said lacing aid being mitten-shaped, said first portion corresponding to the palm/finger portion of the mitten shape and said second portion corresponding to the thumb portion of the mitten shape.

2. The lacing aid of claim 1 wherein said substrate engaging portion comprises a substrate clamp.

3. The lacing of claim 2 wherein said substrate clamp removably engages a substrate.

4. The lacing aid of claim 1, wherein said substrate-engaging portion is substantially rigid.

5. The lacing aid of claim 4 wherein said first and second portions are rotatable about an axis substantially perpendicular to said second portion.

6. The lacing aid of claim 1, further comprising a third portion connected to said first and second portions and adapted for connection with a substrate, wherein said third portion includes a U-shaped clip including two legs extending outwardly from the curved portion of the U, one of said legs including a sleeve, said sleeve rotatably engaging said first portion, said legs carrying, adjacent their extremities, means for fastening said U-shaped clip to said substrate.

7. A lacing aid, comprising:

a first portion forming an opening larger than a lace that promotes slippage between a lace and the lacing aid;

a second lace-restraining portion having a narrow channel extending from said opening for frictional engagement of a lace; and a U-shaped substrate-engaging portion having two legs and a curved portion between said legs, said lacing aid being rotatable connected to said curved portion of said substrate-engaging portion, said lacing aid being mitten-shaped, said first portion corresponding to the palm/finger portion of the mitten shape and said second portion corresponding to the thumb portion of the mitten shape, wherein said first and second portions are formed by a length of bent smooth wire, said first and second portions being joined by a smooth wire portion permitting a lace to slide from said first portion into said second portion.

8. A device for use in lacing footwear, comprising:

a first portion for sliding engagement with a lace, a second portion for gripping engagement of a lace, said first and second portions being adjacent so said lace can be easily transferred from engagement with said first portion to engagement with said second portion, and a third portion connected to said first and second portions and adapted for connection with a substrate of said footwear, wherein said third portion comprises a U-shaped clip including two legs extending outwardly from the curved portion of the U, one of said legs including a sleeve and a detent, said sleeve rotatably engaging said first portion, said detent holding said first portion away from said leg when engaged with said first portion, said legs carrying, adjacent their extremities, means for fastening said U-shaped clip to said substrate.

9. A lacing aid, comprising:

a U-shaped element including a first leg and a second leg extending outwardly from a U junction, the first leg including a portion for rotatably retaining an eyelet on the outside of the U-shaped element, said first and second legs carrying a pair of mating fasteners at their distal ends, wherein said distal end of said first leg is punched to form an opening and an adjacent deformable tab, said pair of mating fasteners including a screw retained in said opening by said deformable tab.

10. The connecting means of claim 9 wherein said U-shaped element is formed from a single bent metal strip, said first leg including an outwardly bent U-shaped, transversely extending sleeve portion for rotatably carrying said eyelet.

11. The connecting means of claim 10 wherein said outwardly bent U-shaped, transversely extending sleeve portion is formed with opposing sides spaced so as to grip said eyelet with a snap-fit.

12. The connecting means of claim 10 wherein said first leg includes a detent adjacent said outwardly bent U-shaped, transversely extending sleeve portion.

13. The connecting means of claim 9 wherein said distal end of said second leg is punched to form an opening adapted for engagement by said screw.

14. The connecting means of claim 9 further comprising means, adjacent said first leg portion, for releasably holding an eyelet extending upwardly from said first leg.

15. A lacing aid, comprising a U-shaped element including a first leg and a second leg extending outwardly from a U junction, the first leg including a portion for rotatably retaining an eyelet on the outside of the U-shaped element, said first and second legs carrying a pair of mating fasteners at their distal ends; and a lacing aid formed from a length of wire with a first portion forming an eyelet and a second portion forming a lace retention portion extending outwardly of said first portion, and a third portion located opposite from said outwardly extending second portion and rotatably engaged with said first leg portion of said connecting means.

16. The connecting means of claim 15 wherein said U-shaped element is formed from a single bent metal strip, said first leg including, as said first leg portion, an outwardly bent, U-shaped transversely extending sleeve portion for rotatably engaging said third portion of said lacing aid, and further including at least one notch formed adjacent said sleeve portion for engagement with said first portion of said lacing aid and holding said lacing aid extending away from said first leg.

17. An apparatus for use in lacing footwear, comprising:

an axle portion having a central axis and being adapted for rotatable connection to footwear;

a lace restraining portion integral with said axle portion, said lace-restraining portion forming a narrow channel extending substantially perpendicular to said axle portion, said channel being adapted so that a lace is frictionally gripped when placed in said channel; and a relatively friction-free lace engaging portion integral with said axle portion and said lace-restraining portion, said lace engaging portion forming an opening extending from said axle portion and communicating with said channel.

18. The apparatus of claim 17, wherein said lace restraining portion and said lace engaging portion form the shape of a mitten.

19. The apparatus of claim 17, wherein said lace restraining portion extends further from said axle portion than said lace engaging portion extends from said axle portion.

20. The apparatus of claim 17, further comprising a footwear connecting portion wherein said footwear connecting portion has a U-shaped clip including two legs extending outwardly from the curved portion of the U, one of said legs including a sleeve, said sleeve rotatably engaging said axle portion, said legs carrying, adjacent their extremities, means for fastening said U-shaped clip to said substrate.

21. The apparatus of claim 20, wherein said leg of said footwear connecting portion that includes a sleeve also includes a detent which holds said lace engaging portion away from said leg when engaged with said lace engaging portion.

22. The apparatus of claim 17, further comprising an article of footwear rotatably connected to said axle portion.

23. A lacing aid for footwear, comprising:

a first portion for sliding engagement with a lace, a second portion for gripping engagement of a lace, said first and second portions being adjacent so said lace can be easily transferred from engagement with said first portion to engagement with said second portion, and a third portion connected to said first and second portions and adapted for connection with a substrate of said footwear, said first, second and third portions being formed by a discontinuous smooth wire, wherein said discontinuous wire has a first end, a second end and a gap between said ends, and said gap is in the middle of said third portion.

24. The lacing aid of claim 23, wherein said second portion extends further from said third portion than said first portion extends from said third portion.

25. The lacing aid of claim 23, wherein said first, second and third portion form substantially the shape of a mitten.

26. The lacing aid of claim 23, wherein said third portion lies substantially on a central axis.

27. The lacing aid of claim 26, wherein one of said first and second ends includes a terminal portion substantially in the shape of a disk.

28. The lacing aid of claim 27, wherein said terminal portion is substantially perpendicular to said central axis.

* * * * *